US010894644B2

(12) United States Patent
Christensen

(10) Patent No.: US 10,894,644 B2
(45) Date of Patent: Jan. 19, 2021

(54) STRETCH HOOD SYSTEM

(71) Applicant: Trioplast Nyborg A/S, Nyborg (DK)

(72) Inventor: Dan Christensen, Langeskov (DK)

( * ) Notice: Subject to any disclaimer, the term of this patent is extended or adjusted under 35 U.S.C. 154(b) by 47 days.

(21) Appl. No.: 16/061,089

(22) PCT Filed: Dec. 21, 2016

(86) PCT No.: PCT/EP2016/082083
§ 371 (c)(1),
(2) Date: Jun. 11, 2018

(87) PCT Pub. No.: WO2017/108894
PCT Pub. Date: Jun. 29, 2017

(65) Prior Publication Data

US 2018/0362233 A1 Dec. 20, 2018

(30) Foreign Application Priority Data

Dec. 22, 2015 (EP) ..... 15202103

(51) Int. Cl.
*B65D 71/06* (2006.01)

(52) U.S. Cl.
CPC ..... *B65D 71/066* (2013.01); *B65D 71/063* (2013.01); *B65D 2571/0003* (2013.01); *B65D 2571/00018* (2013.01)

(58) Field of Classification Search
CPC .. B65D 71/02; B65D 75/006; B65D 71/0088; B65D 71/066; B65D 71/063;
(Continued)

(56) References Cited

U.S. PATENT DOCUMENTS 3,589,510 A 6/1971 Begnaud et al.
3,667,598 A 6/1972 Zelnick et al.
(Continued)

FOREIGN PATENT DOCUMENTS

DE 102012216768 A1 1/2014
EP 2130771 A1 12/2009
WO 03/062062 A1 7/2003

OTHER PUBLICATIONS

International Search Report for PCT/EP2016/082083, ISA/EP, Rijswijk, NL, dated Feb. 7, 2017.
(Continued)

*Primary Examiner* — Steven A. Reynolds
(74) *Attorney, Agent, or Firm* — Harness, Dickey & Pierce, P.L.C.

(57) ABSTRACT

The present disclosure relates to a stretch hood arrangement (200) enclosing a stack of articles (201) arranged on a pallet (203) in multiple layers including a base layer (207), a top layer (209) and one or more intermediate layers, said stretch hood arrangement (200) comprising: a polymer film tubular band (215) stretched around at least the base layer (207) of the stack; a polymer film stretch hood (213) enclosing the top and sides of the stack; characterized in that the polymer film of the tubular band (215) has a higher elasticity than the polymer film of the stretch hood. The present disclosure further relates to the use of a the stretch hood arrangement for collection and transport of a stack of articles (201), preferably for collection and transport of a stack of bottles arranged on a pallet (203) in multiple layers.

20 Claims, 2 Drawing Sheets

(58) Field of Classification Search
CPC .. B65D 2571/00018; B65D 2571/0003; B65D 71/06
USPC ..... 206/597, 497, 386
See application file for complete search history.

(56) References Cited

U.S. PATENT DOCUMENTS

| | | | | | |
|---|---|---|---|---|---|
| 3,670,880 | A * | 6/1972 | Burleson | B65D 71/0096 | 206/386 |
| 5,353,936 | A | 10/1994 | Dockstader et al. | | |
| 5,972,464 | A * | 10/1999 | Pezzuco | B65D 71/0096 | 206/386 |
| 6,471,061 | B1 * | 10/2002 | Teague | B65D 71/0088 | 206/442 |
| 7,934,894 | B1 * | 5/2011 | Temple | B65D 71/0096 | 410/34 |
| 8,231,004 | B2 * | 7/2012 | Port | B65D 71/0096 | 206/597 |
| 9,162,805 | B1 * | 10/2015 | Testa | B65D 71/0096 | |
| 2015/0239639 | A1 * | 8/2015 | Wenner | B65D 81/38 | 206/386 |

OTHER PUBLICATIONS

Written Opinion of the ISA for PCT/EP2016/082083, ISA/EP, Rijswijk, NL, dated Feb. 7, 2017.

* cited by examiner

STRETCH HOOD SYSTEM

CROSS-REFERENCE TO RELATED APPLICATIONS

This application is a 371 U.S. National Stage of International Application No. PCT/EP2016/082083, filed Dec. 21, 2016, which claims priority to European Patent Application No. 15202103.6, filed Dec. 22, 2015. The entire disclosures of the above applications are incorporated herein by reference.

FIELD OF THE INVENTION

The present invention relates to a stretch hood arrangement for enclosing articles with polymer film, particularly for enclosing bottles and similar articles stacked in layers on a pallet for transportation purposes.

BACKGROUND

Large numbers of articles are collected and transported on pallets today. Examples include transport of a large number of uniform articles, such as empty or filled glass bottles, plastic bottles, flowerpots, designer objects or vacuum flasks. These types of articles are commonly stacked in layers on the pallets in order to minimize the amount of dead cargo space during transport. These stacks of articles are often wrapped in a polymer film to protect and keep the articles in place during transport.

One important application is collection of empty glass bottles at the bottle manufacturer for transport to the beverage manufacturer for filling, and transport of the filled bottles from the beverage manufacturer. During transport, typically by truck, the bottles are stacked in several layers, such as up to 10 layers, arranged on a pallet and wrapped in a polymer film to be kept in place during transport, especially in case of a sharp turn or a heavy braking. Some applications, including collection and transport of glass bottles, are more demanding to the polymer film due to their weight. Prior art solutions for wrapping the articles in a polymer film include using so called shrink hoods The shrink hood is mounted on the top and sides of the stack of articles, and crimped in place by exposing the polymer film to heat. When mounted to the stack of articles, the shrink hood exerts a holding force on the stack of articles. Shrink hoods often get folded during mounting, especially at the corners, and these folds may act as breaking lines when exerted to a mechanical force from the stack of articles during for example heavy braking. During rapid deceleration, the base layer of the stack may deform due to bottles partially tipping over. This deformation may cause the shrink hood to tear and subsequently cause bottles to fall out of the hood and break.

In view thereof, there exists a need for improved arrangement for enclosing stacks of bottles, and other heavy duty articles, arranged on a pallet during transportation.

SUMMARY OF THE INVENTION

It is an object of the present invention to address at least some of the deficiencies associated with prior art systems for transporting articles, e.g. bottles, stacked in layers on pallets.

It is an object of the present invention to provide a solution for transporting articles, e.g. bottles, stacked in layers on pallets, which can be performed easily and economically, preferably using existing stretch hood machines.

These and other objects are achieved by the present invention as described with reference to the various aspects and embodiments described herein.

According to a first aspect illustrated herein, there is provided a stretch hood arrangement enclosing a stack of articles arranged on a pallet in multiple layers including a base layer, a top layer and one or more intermediate layers, said stretch hood arrangement comprising:

a polymer film tubular band stretched around at least the base layer of the stack;

a polymer film stretch hood enclosing the top and sides of the stack;

characterized in that the polymer film of the tubular band has a higher elasticity than the polymer film of the stretch hood.

The articles may for example be empty or filled glass bottles, for example wine bottles but they can also be empty or filled beer bottles, soft drink bottles, water bottles, vacuum flasks, home furnishings, designer objects, laboratory glassware, Erlenmeyer flasks, flower pots or flower vases.

It has been found that the base layer of the stack of articles is typically susceptible to temporary or permanent deformation during for example rapid deceleration. The term deformation could for example imply tipping of the articles in the base layer. The term tipping is supposed to be understood as tilting at an angle larger than 0 degrees.

The term polymer film tubular band, as used herein generally denotes a band of polymer film stretched around at least the base layer of the stack. The polymer film tubular band applies a holding force to the layer(s) and acts to prevent permanent deformation of the base layer of the stack of articles. The tubular band is preferably stretched around at least a base layer of the stack of articles. The tubular band may also cover at least a part of the pallet. In the case of deformation of at least the base layer, the tubular band is able to stretch and after reaching a maximum elongation contract and thus applying a force to the deformed base layer that may allow the base layer to return to its initial position. If this situation occurs due to a rapid deceleration, the flexible tubular band might be able to cause the deformed base layer to "re-bounce" i.e. that the articles return to a non deformed state, thus the pressure exerted on the film is relaxed. This is achieved by the tubular bands elastic deformation properties. When subjected to a force, for example from a deformed base layer of a stack of articles, the tubular band will deform predominantly elastically and stretch. After reaching a maximum the tubular band will retract and thus exert a force on the deformed base layer that allows the articles in the base layer to "re-bounce" and return to a non deformed state.

The polymer film stretch hood has the purpose of protecting the stack of articles and keeping the articles in place during transport. The stretch hood preferably covers the top and sides of the stack of articles. It may also cover at least a part of the pallet. The polymer film stretch hood is preferably tough to avoid puncturing during for example permanent or temporary deformation of the base layer of the stack. The polymer film stretch hood may have a lower elasticity but a higher toughness than the polymer film tubular band. The polymer film stretch hood preferably protects the stack of articles from rain, dust, and dirt, and may also serve to prevent vermin, such as rodents or insects, from entering the stack. The stretch hood is preferably UV-stable and preferably preserves its mechanical features in a temperature range of from −20 to +50 degrees Celsius.

The stack of articles is preferably stacked on a pallet. The pallet may for example be a standard Euro-pallet of 120×80 cm, an industrial pallet of 100×120 cm, a "semi-pallet" of 60×80 cm or a quarter pallet of 60×40 cm in size. The pallet may also be of other dimensions known in the art. The stack of articles is preferably dimensioned to fit the pallet. The polymer film stretch hood and tubular band is preferably dimensioned to fit the stack of articles.

The tubular band and the stretch hood are preferably comprising an elastomeric polyolefin, such as copolymers of ethylene. Elastomeric polyolefins are preferred for use in the invention since they have the required mechanical properties for stretch hood applications and can be processed using suitable hot melt processes, such as film blowing or welding etc.

According to some embodiments of the stretch hood arrangement, the elasticity of the polymer films is defined as the elastic recovery of the polymer films as measured according to the elastic recovery and holding force test method as defined herein. The unit of elastic recovery is [%]. The elastic recovery of the tubular band should be high enough to prevent that the tubular band deforms substantially plastically in case of deformation of the base layer of the articles. The stretch hood preferably has a higher toughness and stiffness (i.e. Young's modulus or secant modulus as measured according to the International standard ISO 527-3) than the tubular band, but a lower elastic recovery. It is especially advantageous if neither the stretch hood nor the tubular band shows substantial plastical deformation after being subjected to a tensile force.

According to some embodiments the polymer film tubular band applies a holding force to at least the base layer of the stack of objects and the polymer film stretch hood applies a holding force on the top and the sides of the stack of objects, wherein the stretch hood holding force is higher than the tubular band holding force. The term holding force should be understood as the holding force of the polymer film of the stretch hood or the polymer film of the tubular band. The holding forces discussed in the present disclosure are measured by the elastic recovery and holding force test method as defined herein and the values are given in the unit N/20 mm. The polymer film tubular band holding force may be in the range of 3-7 N/20 mm, such as 3-5 N/20 mm or 4-7 N/20 mm. The holding force of the stretch hood is advantageously in the range of 8-10 N/20 mm, such as 9-10 N/20 mm. A holding force of the stretch hood below 7 N/20 mm may not be sufficient to keep the articles in place during transport. If the holding force of stretch hood is higher than 20 N/20 mm the top layer of articles is at risk of reshaping to an ellipsoidal shape.

According to some embodiments, the layers of the stack are separated by sheets (205) of a rigid material. The sheets (205) are preferably made of a rigid material such as a thermoplastic or corrugated cardboard. The sheets (205) could also be made of a metal, ceramic or a wood material. The sheets are preferably flat and relatively thin, preferably having a thickness of 15 mm or less, such as 5 mm or less.

The stretch hood arrangement is especially advantageous for heavy duty loads, and articles with a shape that makes them susceptible to tipping over.

According to some embodiments, the height of the stack is in the range of 1 to 3 meters. Preferably, the height of the stack is in the range of 1-2.7 meters. The height of the stack is more preferably less than 2.7 meters since 2.7 meters is the maximum height that can be loaded in most trucks.

The weight of the stack of articles is typically in the range of from 500 kg to 1200 kg. The weight of each article is typically in the range of 0.1-0.9 kg. The number of articles in each layer of the stack may typically be in the range of 100-800.

According to some embodiments, the height-to-base width ratio of the articles is at least 2:1, such as at least 3:1. Layers comprising articles with a substantially larger height than bottom width may be susceptible to deformation due to for example a rapid deceleration during transport. Typically the deformation is due to tipping of the articles. The height is measured from top to bottom. The base diameter is measured at the narrowest part of the base. The base of the articles is typically circular but it may also have a polygonal shape. According to some embodiments, the articles have a base diameter D larger than a top diameter d. The articles preferably have tapered form. The tapered form may make the articles in the base layer more prone to tipping. The bottom diameter to top diameter ratio is typically larger than 2:1, more typically larger than 2.5:1.

According to some embodiments, the polymer film tubular band is stretched around the base layer and at least one intermediate layer of the stack.

Preferably, the polymer film tubular band is stretched around the base layer and one intermediate layer. The susceptibility for deformation due to for example tipping of articles is increasing from the top layer to the base layer. Therefore it is preferable that the tubular band is stretched around the layers most susceptible to tipping. These layers are typically the base layer and the intermediate layer adjacent to the base layer.

According to some embodiments, the height of the tubular band is less than 50% of the height of the stack. Since the articles in the base layer and the layers located closest to the base layer are most susceptible to tipping, it is preferable if the tubular band is stretched around these layers exclusively in order to save tubular band material. The layers near the top are less susceptible to tipping. Furthermore, stretching the tubular band around only a lower portion of the stack, such as less than 50% of the height of the stack, saves material and time, while avoiding the application of additional holding force to the uppermost layer(s) which are more prone to reshape to an ellipsoidal shape by internal relocation of the articles in the layer.

According to some embodiments, the height of the tubular band is 40-100 cm, preferably 70-90 cm, more preferably 75-85 cm. The height of the each layer in the stack is typically in the range of 25-40 cm. The height of a wine bottle is typically in the range of 25-33 cm. Since the articles preferably are wine bottles, a tubular band height in the range 75-85 cm would cover at least a base layer of the stack of articles. This is preferred since the base layer is the layer wherein the articles are most susceptible to tipping, for example due to a rapid deceleration during transport.

The tubular band may also be stretched around at least the base layer of the stack of articles in more than one layer of tubular band film. Each layer of tubular band film may optionally be of different heights. For example, the tubular band may be stretched around to cover 2½ layers in the stack of articles with a first layer of tubular band, and 1½ layers in the stack of articles with a second layer of tubular film.

The tubular band may preferably be placed over at least part of the pallet, to further support the stack of articles.

According to a second aspect illustrated herein, there is provided the use of a stretch hood arrangement as described above with reference to the first aspect, for collection and transport of a stack of articles, preferably for collection and transport of a stack of bottles arranged on a pallet in multiple layers. The stretch hood arrangement is especially useful for use in transport of articles susceptible to tipping, such as glass bottles. The polymer film tubular band may assist the articles to return to their initial position in case of tipping, thus reducing the amount of pressure the stretch hood is subjected to.

According to a third aspect illustrated herein, there is provided a method for enclosing a stack of articles, for example bottles, arranged on a pallet in multiple layers including a base layer, a top layer and one or more intermediate layers, said method comprising the steps:

a) applying a polymer film tubular band stretched around at least a base layer of the stack;

b) applying a polymer film stretch hood enclosing the top and sides of the stack;

characterized in that the polymer film of the tubular band has a higher elasticity than the polymer film of the stretch hood.

The stack of articles, polymer film tubular band and polymer film stretch hood may be further defined as described above with reference to the stretch hood arrangement of the first aspect.

According to some embodiments, the elasticity of the polymer films corresponds to the elastic recovery of the polymer films. The elastic recovery may be measured according to the elastic recovery and holding force test method as defined herein. The elastic recovery of the tubular band should be high enough to prevent that the tubular band deforms substantially plastically in case of deformation of the base layer of the articles. The stretch hood preferably has a higher toughness and stiffness (i.e. Young's modulus or secant modulus as measured according to the International standard ISO 527-3) than the tubular band, but a lower elastic recovery. It is especially advantageous if neither the stretch hood nor the tubular band shows substantial plastical deformation after being subjected to a tensile force.

According to some embodiments, the steps a) and b) are performed in sequence. It is preferable if the stretch hood is applied onto the tubular band in order to avoid creating folds or creases where for example dirt, rain and vermin may gather.

According to some embodiments, the steps a) and b) are both performed by a stretch hood machine. The use of a stretch hood machine is preferable since the use of stretch hood machines is common practice in the industry. It is preferred that the inventive stretch hood arrangement can be applied using existing machines.

According to some embodiments, the step of applying the polymer film tubular band further comprises feeding the tubular band from a supply to a pull-down device, pre-stretching the tubular band to 60-100% elongation, pulling the tubular band with the device down over the at least a base layer of the stack, releasing the tubular band from the pull-down device and relaxing the tubular band over at least the base layer of the stack, the polymer film of the tubular band in a relaxed state applying a holding force of 4-6 N/20 mm to a least the base layer of the stack and the step of applying the polymer film stretch hood further comprises feeding the stretch hood from a supply to a pull-down device, pre-stretching the stretch hood to 30-60% elongation, pulling the stretch hood with the device down over the top and sides of the stack, releasing the stretch hood from the pull-down device and relaxing the stretch hood over the top and sides of the stack, the polymer film of the stretch hood in a relaxed state applying a holding force of 8-10 N/20 mm to the top and sides of the stack.

The term "relaxing" is supposed to be understood as the time it takes for the stretch hood or tubular band from its pre-stretched state to reach a state where it exerts its maximum holding force on the sides of the stack or at least a base layer of the stack, respectively.

The stretch hood preferably exerts a higher larger holding force to the sides of the stack than the tubular band exerts to the base layers of the stack.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION OF THE EMBODIMENTS

Figure 1:
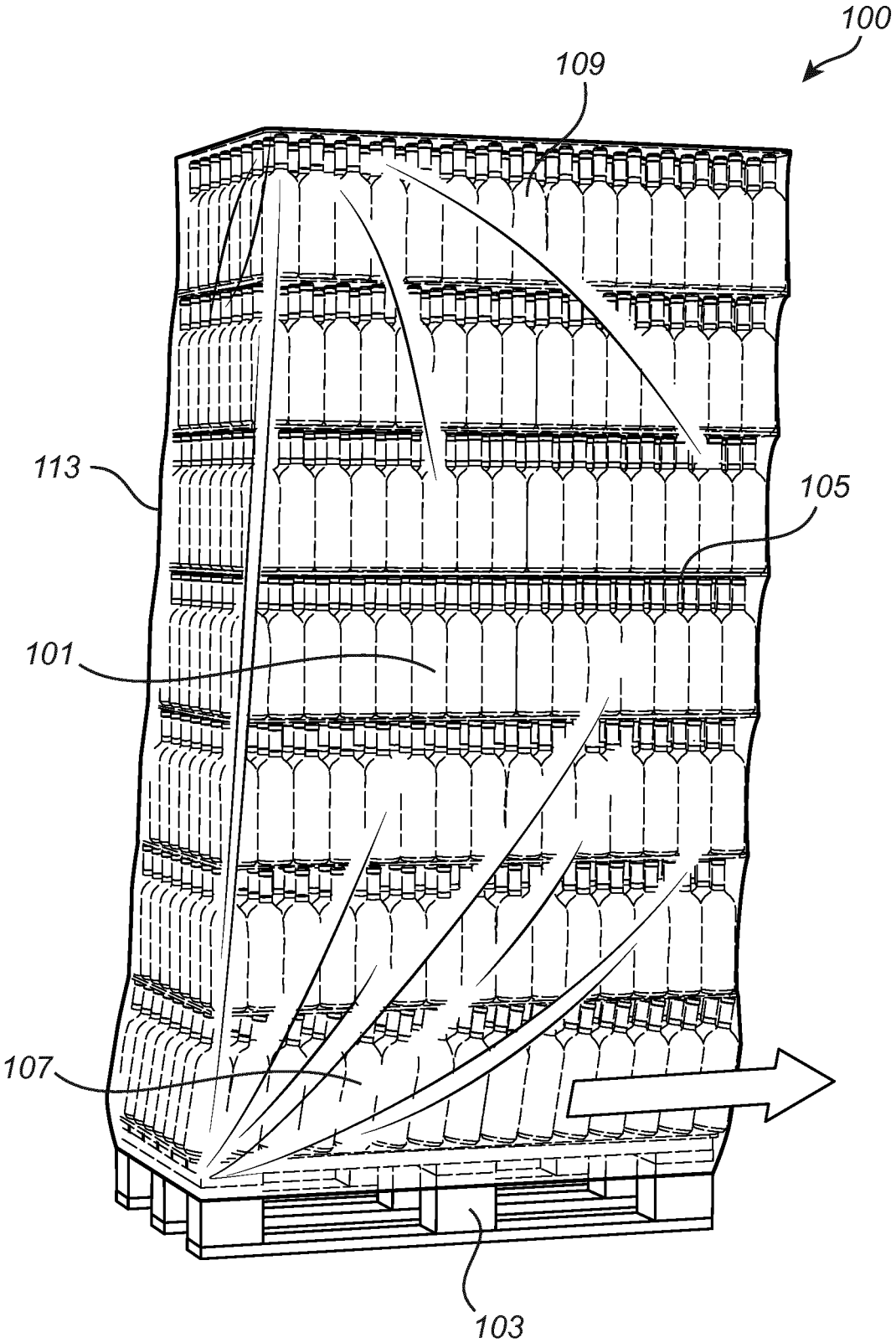
PRIOR ART Fig. 1
FIG. 1 shows a common problem in the prior art, where the base layer of the stack of articles have been partially overbalanced thus deforming the base layer of the stack.

FIG. 1 shows a situation that commonly appears in prior art solutions (100) during transport of a stack of articles (101) arranged on a pallet (103). The stack of articles (101) is arranged on a pallet (103) in multiple layers separated by sheets (105) of rigid material. The stack of articles has a base layer (107), at least one intermediate layer, a top layer (109) and four side walls. The layers have four substantially quadrangular side walls and a substantially quadrangular cross-section. "Substantially quadrangular" in the present disclosure should be understood as substantially rectangular or substantially quadratic. The stack of articles (101) is enclosed by a polymer film (113), for example by a stretch hood film or a shrink hood film.

The situation depicted in FIG. 1 may occur when the stack of articles (101) have been subjected to a rapid deceleration during transport. The base layer (107) has deformed by partial tipping of the articles therein. The intermediate and top layers have deformed to a lesser degree. The deformed base layer (107) exerts a force on the polymer film (113) enclosing the articles. Articles that are in contact with the polymer film (113) may exert a punctual load on the polymer film. This load may be large enough to rupture the film, which may cause the articles to fall out of the stack and break.

The polymer film (113) in the prior art solution may for example be a polymer film shrink hood or a polymer film stretch hood. Both these films are suitable for applying to a stack of articles. When applied to the stack of articles (101), the polymer film (113) comprises a substantially quadrangular closed top and four side walls. The horizontal cross section circumference of the polymer film shrink hood is typically larger than the horizontal cross section circumference of the stack of articles. The polymer film (113) is typically pulled down over the stack so that it encloses the top and sides of the stack. The polymer film is typically top welded just before mounting to form a hood. If the polymer film is a shrink hood, heat may then be applied to the polymer film (113) which may cause the shrink hood to shrink so that it is in contact with the stack of articles (101) and exerts a holding force on the top and sides of the stack of articles. When mounted to the stack of articles (101), the polymer film (113) exerts a holding force on the stack of articles (101). Shrink hoods often get irregularly folded during mounting and heat crimping, especially at the corners, and these folds may act as breaking lines when exerted to a force from the stack of articles during for example heavy braking.

Figure 2:
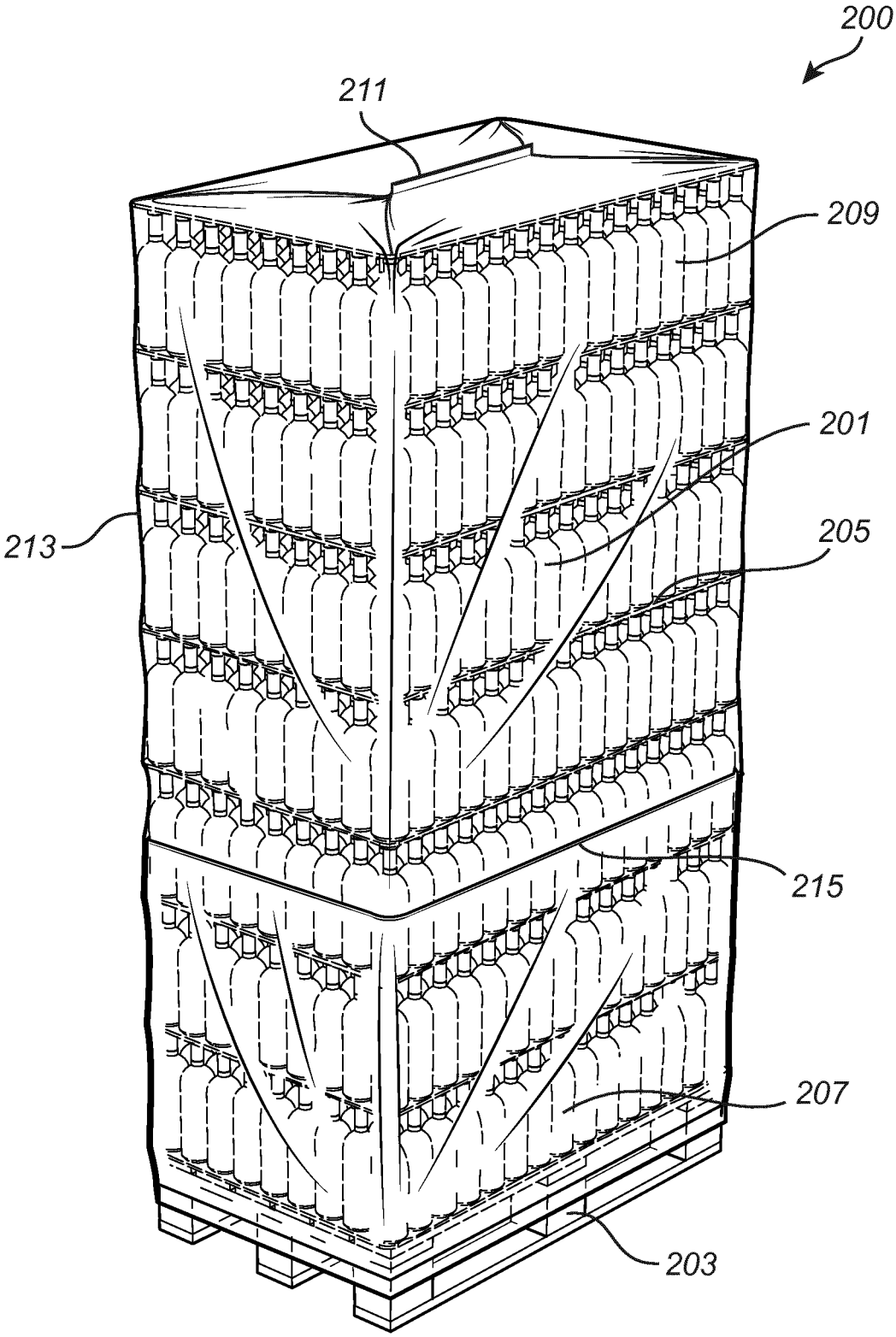
FIG. 2 is a perspective view of an embodiment of the inventive stretch hood arrangement enclosing a stack of articles arranged on a pallet in multiple layers.

FIG. 2 shows an embodiment of the inventive stretch hood arrangement (200). The stretch hood arrangement (200) is depicted in a state where it is applied to a stack of articles (201). The stack of articles (201) is arranged on a pallet (203) in multiple layers separated by sheets (205) of rigid material. The stack of articles has a base layer (207), at least one intermediate layer, a top layer (209) and four side walls. The layers have four substantially quadrangular side walls and a substantially quadrangular cross-section. "Substantially quadrangular" in the present disclosure should be understood as substantially rectangular or substantially quadratic.

The stretch hood arrangement (200) comprises a polymer film stretch hood (213) and a polymer film tubular band (215). The polymer film tubular band (215) is configured to be stretched around all four side walls of at least the base layer (207) of the stack of articles. The tubular band (215) is not closed at its top or bottom. When applied to the stack of articles (201) the tubular band (215) comprises four side walls of substantially the same height. This height of the tubular band (215) is in the present disclosure to be understood as the height of these side walls. The polymer film stretch hood (213) is configured to enclose the top and all four side walls of the stack of articles (201). When applied to the stack of articles (201) the stretch hood (213) comprises a substantially quadrangular top and four side walls. The top of the stretch hood (213) is preferably formed by welding.

The tubular band (215) is typically applied to the stack of articles (201) before the stretch hood (213) is applied. The stretch hood (213) is preferably applied so that it also encloses the tubular band (215). When applied to a stack of articles (201), the stretch hood arrangement (200) is substantially rain and dust proof.

The tubular band (215) is stretched around at least the base layer of the stack of articles (201) by feeding an appropriate length of a tube of polymer film from a roll onto a pull-down device. The circumference of the tube is lower than the horizontal circumference of the stack of articles (201). The pull-down device arranges the tube in a shape corresponding to the geometry of the horizontal cross section of the stack of articles (201). The tube is then cut off from the feed roll, thus forming a tubular band (215). The pull-down device stretches the circumference of the tubular band (215) to a predetermined pre-stretch elongation degree, typically in the range of 60-120%, such as 90-100%, such as about 95%, such that the tubular band (215) in the stretched state has a circumference which is greater than the horizontal circumference of the stack of articles (201). The tubular band (215) is then pulled over at least the base layer (207) of the stack of articles (201), preferably the base layer and one and a half intermediate layers. The tubular band (215) can be applied from the bottom upwards, or from the top down. The tubular band (215) may be doubled over its full height, or parts thereof. The tubular band (215) can for example be applied from bottom to top and back, i.e. in 2 layers, or in one layer on an upper part, and two layers on lower part. The tubular band (215) is then gradually released from the pull-down device. The tubular band (215) will then retract until it is stretched around at least the base layer (207) of the stack of articles (201). The retraction is typically a fast process; a preferable time-frame is less than 1 second. After retraction the tubular band (215) typically has a residual elongation in the range of 50-80%, such as 65-75%, for example about 72%. The residual elongation allows the stretch hood to exert a holding force to at least the base layer of the stack of articles (201). The residual elongation typically comprises both an elastic and a plastic deformation component. Preferably, the plastic deformation component is substantially small. The elastic component of the residual elongation allows the stretch hood to exert a holding force to the top and sides of the stack of articles (201). Residual elongation is supposed to be understood as the elongation of the circumference of the film when the film is applied to the stack of articles (201).

The stretch hood is applied to the stack of articles (201) by feeding an appropriate length of a tube of polymer film from a roll onto a pull-down device. The circumference of the tube is lower than the horizontal circumference of the stack of articles (201). The pull-down device arranges the tube in a shape corresponding to the geometry of the horizontal cross section of the stack. The tube is cut off from the film roll and the cut-off end is joined together by plastic welding forming a top weld (211), thus forming the closed top of the stretch hood. The welding is performed by means well known in the art, for example by electrical induction heated bars. The pull-down device stretches the circumference of the stretch hood to a predetermined pre-stretch degree, typically in the range of 20-60%, such as 40-50%, for example about 44%, such that the stretch hood in the stretched state has a circumference which is greater than the horizontal circumference of the stack of articles (201). The predetermined pre-stretch degree is lower for the stretch hood than for the tubular band (215). The stretch hood is then pulled over the top and sides of the stack of articles (201) and, the stretch hood is gradually released from the pull-down device. The stretch hood will then retract until it is encloses the top and sides of the stack of articles (201). The retraction process typically takes longer time for the stretch hood than for the tubular band (215), preferably a few seconds. After retraction, the stretch hood typically has a residual elongation in the range of 15-30%, such as 20-25%, for example about 22%. The residual elongation is typically caused by both an elastic and a plastic deformation component. Preferably, the plastic deformation component is substantially small, however in practise the elastic recovery of stiff stretch hoods is typically only partial, for example about ¾ of the original deformation. The elastic component of the residual elongation allows the stretch hood to exert a holding force to the top and sides of the stack of articles (201).

The polymer film tubular band (215) has a higher elasticity than the polymer film stretch hood. A higher elasticity typically means a higher elastic recovery. The elastic recovery in the present disclosure is measured in accordance with the elastic recovery and holding force test method as defined herein.

Elastic recovery and holding force in the present disclosure is measured in accordance with an "elastic recovery and holding force test method". The elastic recovery and holding force test method in the present disclosure is defined as follows: A film strip of approximately 20 mm width and length (L) is placed with 100 mm distance between holders in a tensile testing machine well known in the art. The tensile testing machine is of the type defined in the International standard ISO 527-3. The machine stretches the film at a rate of 500 mm/min until the film reaches a predetermined first length (L1), typically to a length in the range of 160-220% of the original length L depending on the film material. The film is kept at the first length (L1) for 60 seconds. The elongation is then reduced 20% to a second length (L2) and kept there for an additional 60 seconds. L2 represents the residual elongation. The load on the sample is then measured and converted to a corresponding force. This force is the holding force [N/20 mm] of the sample. The sample is then released from the holders and after the film has completely relaxed a third length (L3) is measured. The elastic recovery is defined as $$\frac{L1 - L3}{L} \times 100[\%].$$

The polymer film tubular band (215) preferably has an elastic recovery in the range of 60 to 100% as measured by the elastic recovery and holding force test method as defined herein. The polymer film stretch hood typically has a lower elastic recovery, and the elastic recovery is only partial, for example only about ¾ of the original deformation.

When applied to the stack of articles (201), the tubular band (215) and the stretch hood each apply a holding force to the stack. The tubular band (215) applies a holding force to at least the base layer (207) of the stack. When applied to the top and sides of the stack, the stretch hood applies a holding force to the top and sides of the stack of articles (201). All holding forces in the present disclosure are measured according to the elastic recovery and holding force test method as defined herein.

The polymer film of the stretch hood typically has holding force is in the range of 6-12 N/20 mm, preferably approximately 9-10 N/20 mm.

The polymer film of the tubular band (215) is typically has a holding force in the range of 3-7 N/20 mm, such as 3-5 N/20 mm or 4-7 N/20 mm.

If the holding force exceeds a maximum value the layers in the stack of articles (201), particularly in the top layers may deform to an ellipsoidal shape. Thus, it is advantageous if the holding force of the stretch hood does not exceed this maximum value. The combined holding force of the tubular band (215) and the stretch hood is exerted only on the at least a base layer (207) onto which the tubular band (215) is stretched around. These layers are less prone to reshape to an ellipsoidal shape by internal relocation of the articles in the layer, due to the accumulated weight of the higher layers exerting pressure on the lower layers.

The relatively elastic recovery of the tubular band (215) may allow the base layer (207) of the stack of articles (201) to return to its resting position after a dynamic deformation of the stack of articles (201) due to for example rapid deceleration during transportation.

Polymer films suitable for stretch hood applications are well known to the person skilled in the art. Commonly used films are single layer or coextruded blown polyethylene based films. The films typically comprise at least three layers, such as a core layer and two outer skin layers.

The polymer film tubular band (215) advantageously has a thickness in the range of 60-120 μm. The polymer film tubular band (215) may comprise a single layer (mono) or coextruded (coex) film. The polymer film is preferably comprising an elastomeric polyolefin, with a high elasticity such as a propylene-ethylene rubber, or a mixture of this with a high-vinylacetate copolymer with ethylene (EVA), or a ethylene-vinylacetate copolymer with a very high co-monomer content, or a compound of a polyolefin and a thermoplastic elastomer. The coextruded polymer film tubular band (215) may comprise several layers, such as in the range of 2-6 layers. The layers may all be of the same polymer film material or they may be of different polymer film materials.

The polymer film stretch hood advantageously has a thickness in the range of 100-150 μm. The thickness of the stretch hood polymer film is typically larger than the thickness of the polymer film of the tubular band (215). The film may be a single layer (mono) or coextruded (coex) film. The polymer film is preferably made of ethylene-based copolymers or an elastomeric polyolefin. The coextruded polymer film stretch hood may comprise several layers, such as in the range of 2-6 layers. The layers may all be of the same polymer film material or they may be of different polymer film materials. Preferably, the stretch hood film is a 3-layer film, comprising two so called skin layers on each side of a so called core layer. The skin layers are typically suited for welding and advantageously rich in metallocene-based Linear Low Density polyethylene (mLLDPE), and optionally comprise conventional Low density polyethylene or long-chain branched LDPE. The core layer is typically rich in ethylene-vinyl acetate copolymers (EVA) or ethylene butyl acrylate copolymers (EBA), and/or elastomeric polyolefins, or mixtures of these materials.

The stack of articles (201) is typically arranged on a pallet (203) for transport in for example a truck. The pallet (203) could be a standard Euro-pallet of 120×80 cm, an industrial pallet of 100×120 cm, a "semi-pallets" of 60×80 cm or a quarter pallet of 60×40 cm in size. The pallet may also be of other dimensions known in the art. The height of the stack is typically in the range of 150-300 cm, such as 150-250 cm. The stack of articles (201) typically comprises 3-10 layers of articles.

The size stack of articles (201) may advantageously be scaled to correspond to suitable pallet (203) size, for example a standard Euro-pallet of 120×80 cm. When arranged on a Euro-pallet, the stack of articles (201) preferably defines a maximum volume of 2.5 $m^3$.

The layers of the stack are typically separated by separator sheets (205). The sheets (205) separating the layers in the stack of articles (201) are typically made of a rigid material such as a thermoplastic or corrugated cardboard but it could also be a metal, ceramic or a wood material. The sheets (205) are scaled to correspond to suitable pallet (203) size. It is preferable that the sheets (205) do not extend outside the perimeter of the pallet (203). Preferably, the corners of the sheets (205) are rounded. When the articles are arranged on a Euro-pallet, the sheets (205) typically measures a maximum of 120×80 cm, preferably somewhat less. It is advantageous if the sheets (205) have the same aspect ratio as the pallet (203).

The stretch hood arrangement (200) is particularly useful for packaging of heavy duty loads weighing more than 500 kg. Typically the combined weight of the stack of articles (201) may be in the range of 500-1200 kg, for example 800-1000 kg.

The stretch hood arrangement (200) is particularly useful for packaging articles that are susceptible to tipping during for example a rapid deceleration during transport. The stretch hood arrangement (200) is typically suitable for enclosing a stack of articles (201) wherein the articles have a height-to-base width ratio at least of 2:1. The base width is measured at the narrowest part of the base. The base of the articles typically has a circular shape but it could also have a polygonal shape, such as a triangular, quadrangular or hexagonal shape. The base width of the articles typically is in the range of 3-20 cm. The height of the articles typically is in the range of 15-50 cm.

Typically, the articles have a tapered form where the base width is larger the top width. The articles are advantageously wine bottles, but could also be beer bottles, soft drink bottles, water bottles, vacuum flasks, home furnishings, designer objects, laboratory glassware, Erlenmeyer flasks, flower pots or flower vases.

One advantage of the stretch hood arrangement (200) described above is that it may alleviate some of the potential damage associated with the situation depicted in FIG. 1. Load securing of articles which are capable of moving or dislocating internally in the stack of articles (201) is becoming increasingly important in the art. Guidelines for load securing are described in for example the European standard EN 12195. EN 12195 also considers dynamic deformations during emergency situations. If the situation depicted in FIG. 1 occurs due to a rapid deceleration during transport, the flexible tubular band (215) can cause the deformed base layer (207) to "re-bounce" i.e. that the articles return to a non deformed state, thus the pressure exerted on the film is relaxed. This is achieved by the elastic deformation properties of the tubular band (215). When subjected to a force, for example from a deformed base layer (207) of a stack of articles (201), the tubular band (215) will deform elastically and stretch. After reaching a maximum elongation the tubular band (215) will retract and thus exert a force on the deformed base layer (207) that allows the articles in the base layer (207) to "re-bounce" and return to a non deformed state. The rapid deceleration may for example subject the stack of articles (201) to a force of 0.5 G, which is used in the dynamic tests according to for example the European standard EN 12642, Appendix B with 0.5 G lateral and rearward forces.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Example

A standard industrial pallet of 1200×1000 mm size was stacked with empty glass bottles, in 7 layers using plastic separator sheets of 3 mm thickness. Approx. 300 bottles were stacked in each layer. The total height of the load was about 200 cm. D to d ratio of the glass bottles was approx. 2.5:1. Aspect ratio (height-to-base) of the glass bottles was 3.4:1.

A polymer film tubular band of 90 μm film thickness made as a 3-layer coex film having a circumference of 2560 mm, gusseted, with a core layer comprising a elastomeric polypropylene based copolymer with ethylene, and skin layers of metallocene-based Linear Low Density Polyethylene, was stretched around approximately 60 cm height of the stack of articles, plus about 10 cm on the pallet, using a pre-stretch of 95% and 100 mm void space between pallet and grippers in outer position. The tubular band covered 2⅓ layers in height. Active unrolling on a stretch hood machine, from bottom upwards was used. Residual elongation after mounting of the tubular band was 72%.

For the stretch hood, tubular polymer film of 120 μm thickness, having a circumference of 3600 mm was used. The gusseted, stiff film was made as a 3-layer co-ex with an EVA core layer (comonomer content of 8%), and skin layers made dominantly of metallocene-based Linear Low Density Polyethylene. The stretch hood was top welded, pre-stretched 44% and mounted. Residual elongation after mounting of the stretch hood was 22%.

The tubular band and stretch hood enclosed stack of articles was then subjected to a deceleration test, under which the stack was deformed causing tipping of articles in the base layer of about 16°. The articled then re-bounced totally to the original upright position, without causing any rupture or other permanent damage in the stretch hood

The invention claimed is:

1. A stretch hood arrangement enclosing a stack of articles arranged on a pallet in multiple layers including a base layer, a top layer and one or more intermediate layers, the stretch hood arrangement comprising:

a polymer film tubular band stretched around at least the base layer of the stack;

a polymer film stretch hood enclosing a top and sides of the stack; wherein the polymer film of the tubular band has a higher elasticity than the polymer film of the stretch hood, such that said tubular band applies a holding force to at least the base layer and acts to prevent deformation of at least the base layer of the stack of articles.

2. The stretch hood arrangement according to claim 1, wherein the elasticity of the polymer films is defined as the elastic recovery of the polymer films.

3. The stretch hood arrangement according to claim 1, wherein the polymer film of the stretch hood applies a holding force on the top and the sides of the stack of articles, and wherein the holding force of the polymer film of the stretch hood is higher than the holding force of the polymer film of the tubular band.

4. The stretch hood arrangement according to claim 1, wherein the layers of the stack are separated by sheets of a rigid material.

5. The stretch hood arrangement according to claim 1, wherein the weight of the stack of articles is at least 500 kg.

6. The stretch hood arrangement according to claim 1, wherein the height:base width ratio of the articles is at least 2:1.

7. The stretch hood arrangement according to claim 1, wherein the articles have a base diameter D larger than a top diameter d.

8. The stretch hood arrangement according to claim 1, wherein the height of the stack is in the range of 1 to 3 meters.

9. The stretch hood arrangement according to claim 1, wherein the polymer film tubular band is stretched around the base layer and at least one intermediate layer of the stack.

10. The stretch hood arrangement according to claim 1, wherein the height of the tubular band is less than 50% of the height of the stack.

11. The stretch hood arrangement according to claim 1, wherein the height of the tubular band is between 60-100 cm.

12. Use of a stretch hood arrangement according to claim 1 for collection and transport of a stack of articles, arranged on a pallet in multiple layers.

13. The stretch hood arrangement according to claim 1, wherein the height of the tubular band is between 70-90 cm.

14. The stretch hood arrangement according to claim 1, wherein the height of the tubular band is between 75-95 cm.

15. A method for enclosing a stack of articles, arranged on a pallet in multiple layers including a base layer, a top layer and one or more intermediate layers, said method comprising the steps:

a) applying a polymer film tubular band stretched around at least a base layer of the stack;

b) applying a polymer film stretch hood enclosing a top and sides of the stack; wherein the polymer film of the tubular band has a higher elasticity than the polymer film of the stretch hood, such that said tubular band applies a holding force to at least the base layer and acts to prevent deformation of at least the base layer of the stack of articles.

16. The method according to claim 15, wherein the steps a) and b) are performed in sequence.

17. The method according to claim 16, wherein the steps a) and b) are both performed by a stretch hood machine.

18. The method according to claim 17, wherein the step of applying the polymer film tubular band further comprises feeding the tubular band from a supply to a pull-down device, pre-stretching the tubular band to 60-90% elongation, pulling the tubular band with the device down over the at least a base layer of the stack, releasing the tubular band from the pull-down device and relaxing the tubular band over at least the base layer of the stack, the tubular band in a relaxed state applying a holding force of 3-7 N/20 mm to a least the base layer of the stack and the step of applying the polymer film stretch hood further comprises feeding the stretch hood from a supply to a pull-down device, pre-stretching the stretch hood to 30-60% elongation, pulling the stretch hood with the device down over the top and sides of the stack, releasing the stretch hood from the pull-down device and relaxing the stretch hood over the top and sides of the stack, the stretch hood in a relaxed state applying a holding force of 6-10 N/20 mm to the top and sides of the stack.

19. The method according to claim 15, wherein the steps a) and b) are both performed by a stretch hood machine.

20. The method according to claim 19, wherein the step of applying the polymer film tubular band further comprises feeding the tubular band from a supply to a pull-down device, pre-stretching the tubular band to 60-90% elongation, pulling the tubular band with the device down over the at least a base layer of the stack, releasing the tubular band from the pull-down device and relaxing the tubular band over at least the base layer of the stack, the tubular band in a relaxed state applying a holding force of 3-7 N/20 mm to a least the base layer of the stack and the step of applying the polymer film stretch hood further comprises feeding the stretch hood from a supply to a pull-down device, pre-stretching the stretch hood to 30-60% elongation, pulling the stretch hood with the device down over the top and sides of the stack, releasing the stretch hood from the pull-down device and relaxing the stretch hood over the top and sides of the stack, the stretch hood in a relaxed state applying a holding force of 6-10 N/20 mm to the top and sides of the stack.

* * * * *